US008819959B2

(12) United States Patent
Klug et al.

(10) Patent No.: US 8,819,959 B2
(45) Date of Patent: Sep. 2, 2014

(54) NOZZLE AND ADDITIVE SUPPLY ARRANGEMENT FOR A TEXTILES TREATMENT APPARATUS

(75) Inventors: Hans-Joachim Klug, Winkelhaid (DE); Luigi Arreghini, Portogruaro (IT); Johannes Sierl, Nürnberg (DE); Thomas Loy, Nürnberg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 759 days.

(21) Appl. No.: 12/513,610

(22) PCT Filed: Nov. 5, 2007

(86) PCT No.: PCT/EP2007/009548

§ 371 (c)(1),
(2), (4) Date: Aug. 24, 2009

(87) PCT Pub. No.: WO2008/058645

PCT Pub. Date: May 22, 2008

(65) Prior Publication Data

US 2010/0083532 A1 Apr. 8, 2010

(30) Foreign Application Priority Data

Nov. 15, 2006 (EP) ..... 06023712

(51) Int. Cl.

| | |
|---|---|
| ***F26B 11/02*** | (2006.01) |
| ***F26B 17/00*** | (2006.01) |
| ***F24D 19/08*** | (2006.01) |
| ***F16T 1/34*** | (2006.01) |
| ***D06F 39/08*** | (2006.01) |
| ***D06F 73/02*** | (2006.01) |
| ***D06F 39/02*** | (2006.01) |
| ***D06F 58/20*** | (2006.01) |

(52) U.S. Cl.

CPC ..... *D06F 58/203* (2013.01); *D06F 39/088* (2013.01); *D06F 73/02* (2013.01); *D06F 39/022* (2013.01)

USPC ..... 34/597; 34/585; 137/201; 137/177

(58) Field of Classification Search

USPC ..... 34/597, 108, 130, 596, 541, 542, 585, 34/587, 638, 642; 137/177, 201; 62/150, 62/272, 285, 288, 291; 239/698

See application file for complete search history.

(56) References Cited

U.S. PATENT DOCUMENTS 3,617,208 A * 11/1971 Burger ..... 8/142
3,739,496 A * 6/1973 Buckley et al. ..... 34/210

(Continued)

FOREIGN PATENT DOCUMENTS

DE 3408136 9/1985
DE 4032490 C1 * 1/1992

(Continued)

OTHER PUBLICATIONS

European Search Report completed on Dec. 3, 2010 in related European Application No. 10181585.

(Continued)

*Primary Examiner* — Kenneth Rinehart
*Assistant Examiner* — John McCormack
(74) *Attorney, Agent, or Firm* — Banner & Witcoff, Ltd

(57) ABSTRACT

The invention relates to a nozzle arrangement (6) adapted to supply at least one fluid-phase additive into a storing compartment (4) of a textiles treatment apparatus (2), in particular an exhaust air and/or condenser dryer, a refreshment apparatus or a washing machine having drying function. The nozzle arrangement comprises at least one nozzle (8), each being adapted to feed an additive; and at least one trapping device (10) adapted to trap and/or to remove liquid and/or particles leaving the at least one nozzle (8) or forming at or close to said nozzle. Further, the invention relates to an additive supply arrangement (6, 18, 20, 22, 12) adapted to supply at least one additive, comprising at least one nozzle (8), each being adapted to feed an additive; at least one additive supply source (12); and at least one fluid channel (18, 20) connecting the at least one additive supply source (12) to the at least one nozzle (8); wherein at least one fluid channel comprises at least one capillary element.

23 Claims, 3 Drawing Sheets

(56) References Cited

U.S. PATENT DOCUMENTS

| | | | | |
|---|---|---|---|---|
| 3,816,070 | A | 6/1974 | Candor et al. | |
| 4,111,645 | A | 9/1978 | Zurbuchen et al. | |
| 4,207,683 | A * | 6/1980 | Horton | 34/60 |
| 4,739,698 | A * | 4/1988 | Allaire | 99/410 |
| 4,955,268 | A * | 9/1990 | Ickinger et al. | 492/46 |
| 5,060,686 | A * | 10/1991 | Troy | 137/171 |
| 5,219,371 | A | 6/1993 | Shim et al. | |
| 7,325,330 | B2 * | 2/2008 | Kim et al. | 34/407 |
| 8,061,066 | B2 * | 11/2011 | Hong et al. | 38/14 |
| 2006/0112683 | A1 * | 6/2006 | Huber | 60/324 |
| 2009/0169342 | A1 * | 7/2009 | Yoshimura et al. | 414/217 |

FOREIGN PATENT DOCUMENTS

| | | | |
|---|---|---|---|
| EP | 1441060 | | 7/2004 |
| JP | 2001190632 | A * | 7/2001 |
| WO | 03/089710 | | 10/2003 |

OTHER PUBLICATIONS

International Search Report Issued Feb. 15, 2008 for PCT/EP2007/009548 (WO 2008/058645 A1).

* cited by examiner

NOZZLE AND ADDITIVE SUPPLY ARRANGEMENT FOR A TEXTILES TREATMENT APPARATUS

BACKGROUND OF THE INVENTION

The invention relates to a nozzle arrangement for supplying at least one fluid additive into a storing compartment of a textiles treatment apparatus, to a fluid supply arrangement for supplying the additive, and to a textiles treatment apparatus having a nozzle arrangement and/or a fluid supply arrangement.

EP 1 441 060 A1 discloses a tumble dryer having one or two injection units arranged in proximity of the loading door of the dryer to inject an additive like water steam, a cleaning detergent, a fragrance or a disinfectant into a rotatable drum. It is proposed to reduce, stop or reverse the airflow through the drum to optimize the efficiency of the injected additive. The amount of additive to be supplied by the injection units into the drum is adjusted by a dosing unit.

SUMMARY OF SELECTED INVENTIVE ASPECTS

It is an object of the invention to provide a nozzle arrangement, an additive supply arrangement and a textiles treatment apparatus having a nozzle arrangement and/or an additive supply arrangement, which are adapted to remove or trap liquids or particles which may form during the supply of an additive.

Inventive aspects are defined in the claims.

Particular embodiments are set out in the dependent claims.

When using a steam injector directly injecting the steam into a drum of a dryer, the steam may condensate and form droplets, for example in the pipe passage from the steam generator to the nozzle, in the nozzle or close to the exit of the nozzle. In particular in the starting phase, when the walls of the supply pipe and the nozzle are cold, the likelihood of condensation is high. Due to the steam flow coming from the steam generator, condensed droplets may be taken along through the pipe and nozzle, and may be sprayed onto the textiles to be treated with the steam-phase additive. Such droplets are inefficient in the textiles treatment and may also result in an inhomogeneous treatment result at the textiles.

The invention relates to measures to avoid droplets or particles, which can condensate or form from the supplied fluid additive, to come into contact with the laundry or with other parts of the textiles treatment apparatus or with the user's hands during loading or unloading the textiles treatment apparatus.

In the following the term "fluid" includes gas-phase, liquid-phase and suspension-phase. "Gas-phase" includes steam-phase, fog-phase, aerosol-phase of a substance, or a mixture of substances or states of substances, or mixtures of substances in different states (e.g. fog or aerosol). Most preferably, the fluid additive transported by a channel (upstream), sprayed by a nozzle or sprayed into a storing compartment is a gas-phase additive as mentioned. The gas-phase can be generated in or at the nozzle, by spraying from the nozzle or downstream from the nozzle. The (sprayed or injected) additive is preferably steam, more preferably water steam or water steam comprising another additive. Additives generally may be perfumes, disinfectants, softener, detergents, dry cleaners, water, or any mixture thereof. "Particles" may be lime residues, precipitations of the additives, or the like. "Trapping" also includes collecting or catching the liquid, droplets and/or particles.

According to an aspect of the invention, a nozzle arrangement is provided which is used to supply at least one fluid-phase additive into a storing compartment of a textiles treatment apparatus. The nozzle arrangement comprises at least one nozzle, wherein each of the nozzles is adapted to feed a fluid. Preferably, the nozzle arrangement is adapted to be arranged at or close to an inner wall of the storing compartment. If, for example, the storing compartment comprises a rotatable drum, a loading door and a frame surrounding the loading door, then the nozzle arrangement is preferably arranged at the door frame or the door or is provided partially at the door and the door frame. Optionally or additionally one of the nozzles or the nozzle arrangement is provided at a back wall of the rotatable drum, for example stationary arranged at a center of the back wall (axial arrangement).

Further, the nozzle arrangement comprises at least one trapping device, which is or wherein each is adapted to trap and/or remove liquid and/or particles leaving the at least one nozzle or forming at or close to the nozzle. If, for example, fluid is transported through a supply channel to the nozzle, then the fluid is for example trapped within the nozzle or at the exit of the nozzle, such that no liquid droplets are sprayed out of the nozzle. Alternatively or additionally, the trapping device is arranged below or around the nozzle's exit such that droplets exiting the nozzle orifice are caught at the trapping device and guided away from the steam or gas injection path of the nozzle. For example, a mesh or grid can be provided, which the gas-phase additive has to pass from the nozzle, and where bigger droplets (bigger than aerosol droplets) are stopped and drained away from the nozzle jet path.

As another or additional example a porous material, like a sponge element, traps droplets formed in the fluid path in its porous structure, while the gasphase flow can pass the pores.

According to a preferred embodiment, the at least one trapping device comprises a draining channel which assists in draining away the droplets and small particles from the spraying or injecting path of the nozzle. This avoids an accumulation of liquids or particles close to the nozzle, and minimizes the risk of carrying them along in the injection path. In a preferred embodiment the draining away of liquids is enhanced by providing capillary elements, which decreases the surface tension and improves the draining off and sucking away of liquid accumulations and droplets.

Preferably the nozzle arrangement is formed of one piece, for example as an injection molding or cast part.

In a further embodiment the at least one trapping device and/or the at least one nozzle comprises at least in some surface areas (e.g. nozzle orifice or surrounding area) an anti-adhesive surface layer, or a surface tension reducing surface layer or material, or a combination thereof. The anti-adhesive layer or material results in smaller droplets and a higher mobility of the droplets improving the removal. For example the orifice and/or trapping device are at least partially formed of Teflon, PTFE, material having a Lotus-effect or are coated therewith. The surface reducing surface layer or material from which the element is formed results in a higher wetting of the surface and enhances thereby the draining of condensed liquid as in the capillary effect. Such coatings and/or material selections are also fully applicable to at least one fluid channel as mentioned below.

In a preferred embodiment the at least one draining channel is in fluid communication with a container adapted to collect the discharged fluid and/or particles. The container can be emptied by a user from time to time or the collected liquid can for example be reused in a fluid generator to generate the gas-phase additive. Or the liquid from the container can be transferred to another container, for example by pumping it to the another container.

To improve the user comfort or the controllability of the gas-phase injection of the at least one additive by the nozzle arrangement, the at least one trapping device and/or the at least one nozzle or a position thereof is moveably arranged. If, for example, the spraying angle of the nozzle can be adapted, it can be adjusted to spray the additive to the most efficient position within the storing compartment. Also the moveable trapping device or a portion thereof can be adjusted, such that in nearly all directions of the injected gas-phase additive the droplets, particles and residues are efficiently collected at the at least one trapping device or the moveable portion thereof.

In a preferred embodiment the movement of the at least one nozzle and/or the trapping device is effected during or by the opening and closing of a loading door for loading the articles to be treated into the storing compartment. In this case, for example, the gas-phase liquid injection path is deflected away from the loaded textiles and/or from the loading path for loading and unloading the articles to the storing compartment by the user. The injection path may be deflected, for example by moving the nozzle or by moving the trapping device or position thereof or both. In one embodiment the deflection is made by moving the nozzle or the moveable trapping device position, such that the steam exiting the orifice of the nozzle is deflected into a draining channel, such that for example the deflected gas-phase additive is discharged into a container or to the circulation channel of a dryer. For example, the injected additive is deflected into the direction of a condenser of the dryer.

In an embodiment the movement of the at least one trapping device, of the nozzle or a portion thereof is made by an actuation or agitating device. For example, the agitating device may be controlled by a control unit of the textile treating apparatus like an electromagnetic switch or a valve. Further, the agitating device may comprise one or more of: a motor, an elastic element, a spring, and a bimetal. Or it may be mechanically actuated, for example when moving the loading door or when the user moves the opening handle for opening the loading door. Also a security circuitry may be provided which stops the steam generation and actuates the moveable nozzle, trapping device or portion thereof as soon as the textiles treatment process is interrupted. For example, when switching the textile treatment apparatus off or when opening the loading door.

By providing condensation elements at the at least one trapping device the condensation there is enhanced or catalyzed, such that some liquid may condensate from an oversaturated steam to avoid droplet formation in some distance from the nozzle orifice.

In a further embodiment the at least one trapping device is adapted to restrict the articles to be treated to come into contact with the nozzle or with position close to the nozzle where liquid may condensate. Thereby, a direct contact between the articles to be treated with condensed liquid is avoided and also the propagation path of the injected additive can not be completely blocked by the articles to be treated. If, for example, the gas-phase additive is to be injected into a rotating drum and the articles are textiles which tumble in the drum, then the at least one trapping device prevents a temporary blocking of the injection path.

According to another aspect of the invention, a fluid supply arrangement is provided which comprises at least one nozzle, each being adapted to supply a gas-phase additive, at least one fluid supply source which generates or provides a gas-phase additive to be injected by the nozzle, for example to be injected into a storing compartment of a textiles treatment apparatus, and also which comprises at least one fluid channel connecting the at least one additive supply source to the at least one nozzle. As mentioned above, the gas-phase additive supplied by the supply source may condense on its path in the fluid channel from the supply source to the at least one nozzle, which would result in blocking or partially blocking the fluid channel. To improve the draining of the liquid or small particles which can be transported by the draining liquid, at least one capillary element is provided or formed in the fluid channel. This means that the at least one capillary element may be part of the fluid channel, i.e. the at least one capillary element is formed at an inner wall or at the interior of the channel, and/or an additional element is placed within the fluid channel to be active as at least one capillary element.

Preferably, the capillary element extends along the complete length of the fluid channel, however, one or more capillary elements may be distributed over positions of the fluid channel, for example a plurality of capillary elements interacting with each other, such that the draining of condensed liquid and particles to the end of the fluid channel is steady and improved. For example the cross-section of the fluid channel is not round, but has an angle smaller than 140°, preferably smaller than 120°, more preferably smaller than 90°. Alternatively or additionally, a wire or fiber or the like is inserted into the channel, which at least partially touches the inner surface of the channel and forms capillary elements thereby. Preferably, the wire or fiber is spirally or helically formed at the inside of the channel, such that in addition to the draining function a mechanical support is provided, which for example avoids a bending or folding of the channel.

In a further additional or alternative embodiment at least two channels are connected at least over a portion of their length, which means that they can be connected over the complete length, punctually over the length or intermittently over the length. At least one capillary fluid connection is provided between the insides or interiors of the at least two fluid channels, such that liquid can drain from one of the channels to the other channel. For example, one of the channels is used as an upstream channel providing the gas-phase additive from the additive supply source to the at least one nozzle, and the other one is a downstream channel draining condensed liquid and particles from the direction of the nozzle into the direction of the supply source. If, for example, the at least one nozzle is part of a nozzle arrangement as mentioned above, the downstream channel is not only used to drain condensed liquid from the upstream channel, but also to drain liquid and small particles caught or trapped at or close to the nozzle.

Preferably and as mentioned above, the downstream channel is in communication with a liquid collector or container which may be emptied by a user from time to time or from where the liquid is fed to the supply source and/or another liquid container and/or to the outside of the textiles treatment apparatus.

A textiles treatment apparatus according to another aspect comprises at least one nozzle arrangement as described above and/or at least one fluid supply arrangement as described above. Preferably, it comprises a storing compartment for storing articles to be treated and a loading opening to load and unload the articles. In a preferred embodiment and as described above, the nozzle arrangement is arranged at or close to the loading opening, e.g. at the frame of the loading opening or a loading door. In a further embodiment, the nozzle arrangement is partially formed at the door, and partially at the frame for the loading door.

In a further embodiment the fluid supply arrangement is also at least partially formed at or close to the loading door, for example at the loading door, at the frame of the loading door or partially at the frame of the loading door, and partially at the loading door.

The embodiments mentioned above can be combined in any form without restrictions. The fluid supply arrangement can for example be provided as an integrated or at least partially integrated unit. Further, the nozzle arrangement can be provided as an upgrade kit to an existing nozzle arrangement, for example to provide the draining function for draining off condensed liquids. Also the supply unit and/or the draining unit can be integrated in the loading door or in the frame of the loading door to simplify the maintenance and also the upgrading.

BRIEF DESCRIPTION OF THE DRAWINGS

Reference is made in detail to preferred embodiments of the invention, examples of which are illustrated in the accompanying drawings, which show.

DETAILED DESCRIPTION OF ILLUSTRATIVE EMBODIMENTS

Figure 1:
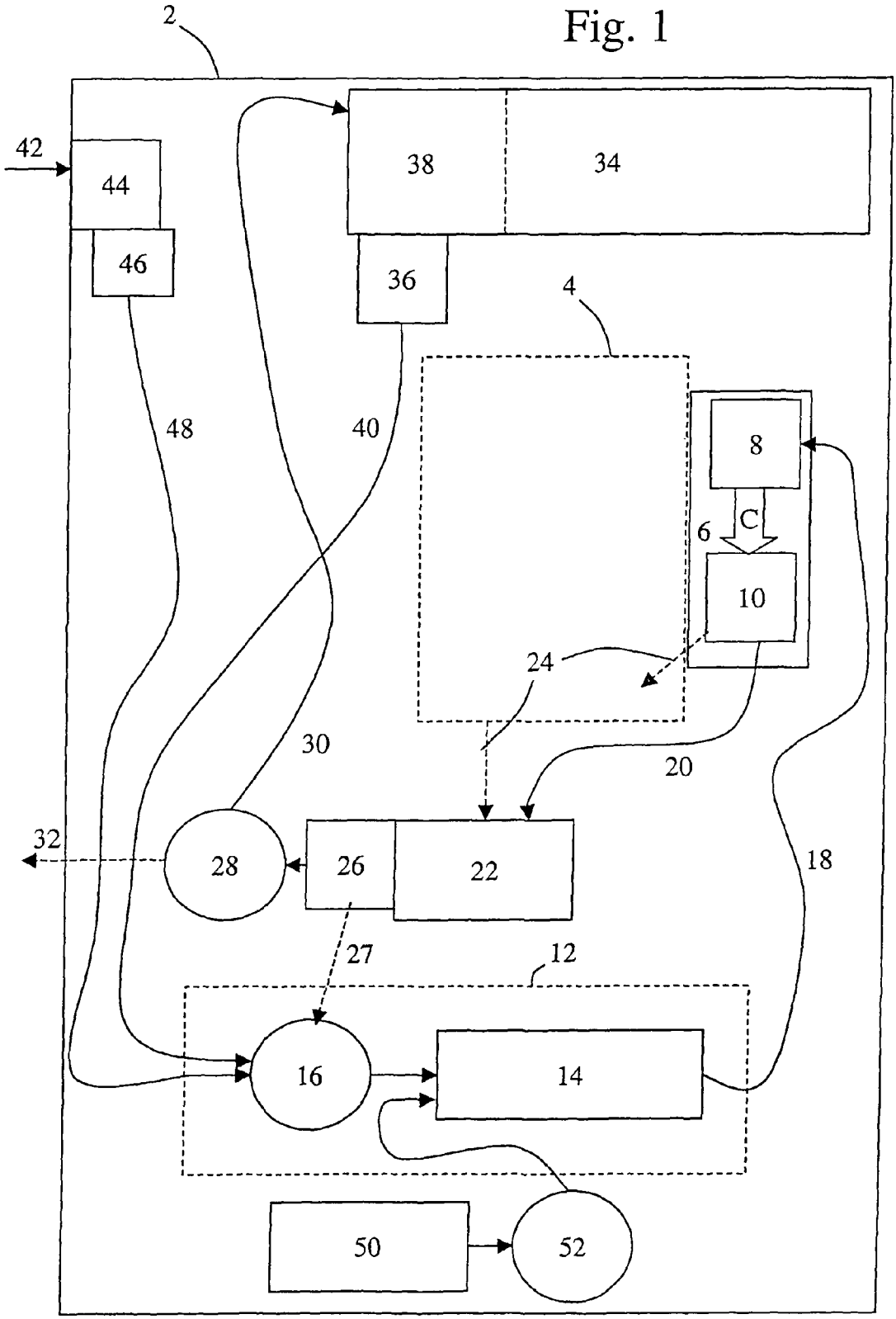
FIG. 1 a schematic block diagram of functional elements of a refreshment dryer, FIG. 2A a view onto the exit side of a nozzle arrangement on the inner side of a loading frame of a dryer, FIG. 2B an inclined view from above onto the inside of the loading door frame with the nozzle arrangement of FIG. 2A, FIG. 2C another embodiment of a nozzle arrangement shown from the exit side, FIG. 3A a side view of a nozzle arrangement connected to upstream and downstream hoses, FIG. 3B a detailed view of the upstream and downstream hoses of FIG. 3A, FIG. 4A another embodiment of a steam supply hose in cross-sectional view, and FIG. 4B a further embodiment of a steam supply pipe in cross-sectional view.

FIG. 1 shows a schematic block diagram of functional elements of a refreshment dryer 2. The refreshment dryer 2 is a condensate dryer additionally having a steam supply unit 12 for supplying steam into the rotatable drum 4 during steam supply phases. In sight contact with the inside of drum 4, a nozzle unit 6 is arranged at the inner side of a door frame 68 (compare FIG. 2A). The nozzle unit 6 comprises a spray nozzle 8 to inject a steam jet into the interior of drum 4. Condensate C may form at the exit of the spray nozzle 8 or in the surrounding of nozzle 8, and the condensate C is trapped here by a drip collector 10 draining the trapped liquid via a drain hose 20 to a sink/condensate reservoir 22. The steam sprayed by nozzle 8 is generated in a steam generator 14 of the supply unit 12 and flows through a steam hose 18 to nozzle 8. Water is supplied via a pump 16 into the steam generator 14 having a heater.

The sink/condensate reservoir 22 may be used at the same time as a condensate sink in a condenser of the condenser dryer. If, on the other hand, the steam treatment apparatus is for example a washing machine having a drying function, then the liquid from the drip collector 10 can also be drained into the tub of the washing machine, and from there via a tub drainage into the condensate reservoir 22 as indicated by the dashed arrow 24.

From the condensate reservoir 22 the condensed liquid may be passed through a filter 26 and supplied to the pump 16 for feeding the steam generator 14. Alternatively, a pump 28 can pump the liquid through a condensate line 30 into a condensate drawer 34 which can be taken out of the dryer to discharge the condensate from drying circles and from the steam condensate collection. Alternatively or additionally, the pump 28 pumps the condensate out of the dryer 2 to outlet 32. In the case that the textiles treatment apparatus is a washing machine, pump 28 may be a draining pump connected to the sink of a washing tub, such that the additive condensate is pumped through the conventional draining hose.

When the condensate is collected in the condensate drawer 34, the condensate is passed through a filter 36 and then supplied via an additive line 40 to pump 16. Alternatively or additionally, the additive to be supplied via pump 16 to the steam generator 14 may be provided from a separate additive tank 38 as indicated by the dashed line, wherein the additive to be used during the steam supply is filled in by the user. Preferably, tank 38 is integrated in the drawer 34. Alternatively or additionally, freshwater is supplied to the steam generator 14, wherein the dryer or the washing machine having drying and steam treatment function is connected to a freshwater tap 42. A valve or dosing unit 44 is opened and closed or activated to pass freshwater through an optional decalcifier or softener 46 either to pump 16 or directly into steam generator 14 via water line 48.

Optionally, a second additive reservoir 50 is provided, wherein a pump 52 pumps the additional additive into the steam generator 14. The additional additive can be mixed to the condensate or water supplied via pump 16 (lines 48, 40 or 27), or the additional additive is supplied to the steam generator 14 without water or condensate, such that in the supply phases only the additional additive is injected into the drum 4.

It is to be noted that not all elements shown in FIG. 1 have to be provided at the same time in a working refreshment dryer. For example, an additive, preferably water to be transformed into steam, is provided by one or more of the sources: the freshwater tap 42, the condensate drawer 34, the additive tank 38 or the condensate reservoir 22. Also one or more of the draining passages for removing the condensed liquid may be provided.

Figure 2A:
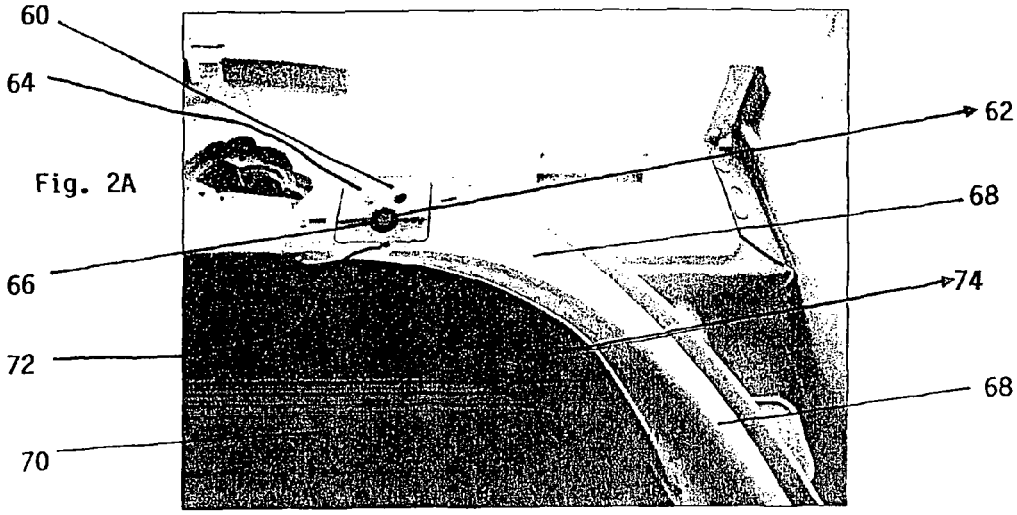

FIG. 2A shows a partial view of a door frame 68 in a demounted state (where the drum is removed at the inner wall of the dryer). A first embodiment of a nozzle unit 60 is integrated in the door frame 68 and has a steam nozzle 62 to inject the steam supplied from steam generator 14 via steam hose 18 into the inside of the drum 4. In the shown perspective the steam jet would approximately be perpendicular to the drawing plane. In addition to the steam nozzle 62, an additive nozzle 64 is provided, through which an additional additive can be injected into the drum. The additional additive is for example a perfume, a softener, a disinfectant, or the like. Below the two nozzles 62, 64 a screw hole 66 is arranged to screw the nozzle unit 60 to the door frame 68. Below the upper section of door frame 68 (as shown in FIG. 2A) the loading opening 70 is arranged, which is to be loaded from the back side of the drawing plane. At the inner perimeter of the door frame 68 a fluid ledge 74 is arranged, which protrudes from the door frame 68 into the interior of the drum 4 and which catches droplets coming from the nozzles 62, 64. A groove 72 runs from the nozzles 62, 64 downward (compare FIG. 2C) to guide the fluid or droplets to the fluid ledge 74 where the liquid is running alongside the door frame 68 and is thereby removed from the drum or from the loading opening of the dryer 2.

Figure 2B:
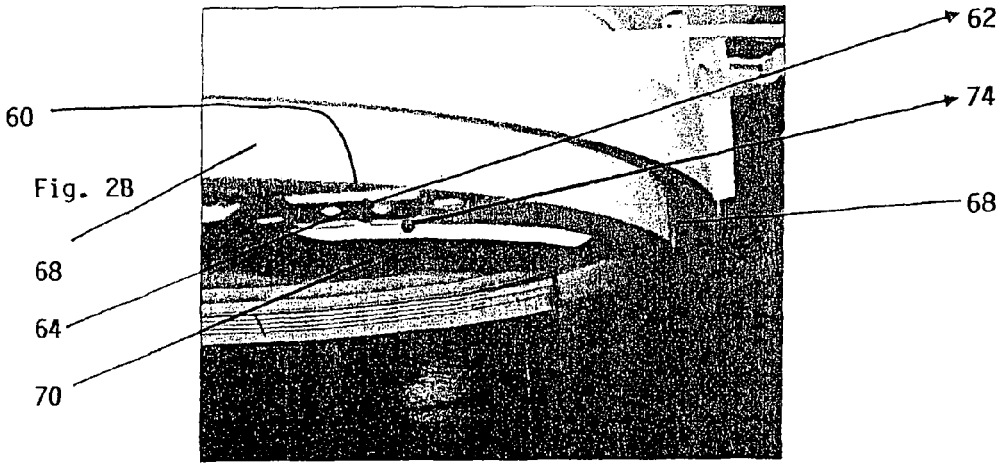

FIG. 2B shows the arrangement of FIG. 2A from another perspective, namely inclined from above, such that the protrusion of the fluid ledge 74 from the inner side of door frame 68 can better be seen.

Figure 2C:
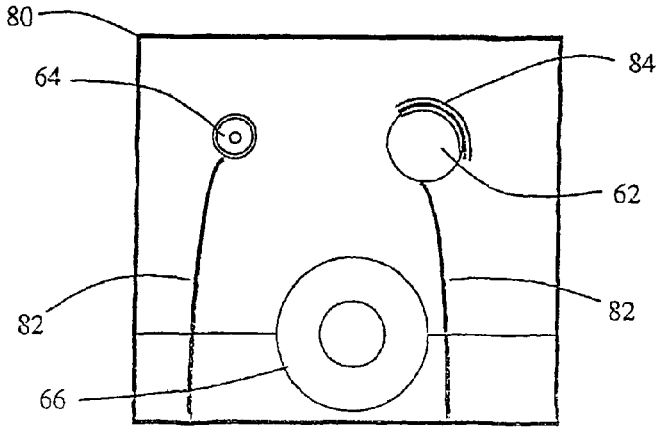

FIG. 2C shows a spray unit 80 in more detail as compared to the spray unit 60 shown in FIGS. 2A and 2B. Again, the two nozzles 62 and 64 and the screw hole 66 are provided. Capillary grooves 82 are running downward from the nozzles 62, 64 to guide the liquid and droplets to the fluid ledge 74. The orifice of the steam nozzle 62 is screened by a guiding vane 84 directing the steam injected from the nozzle into the center of the drum 4.

Figure 3A:
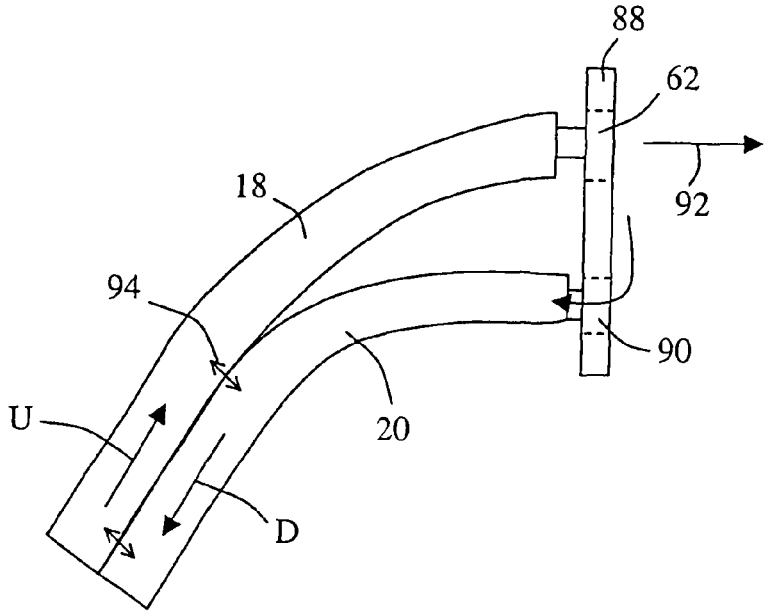
Figure 3B:
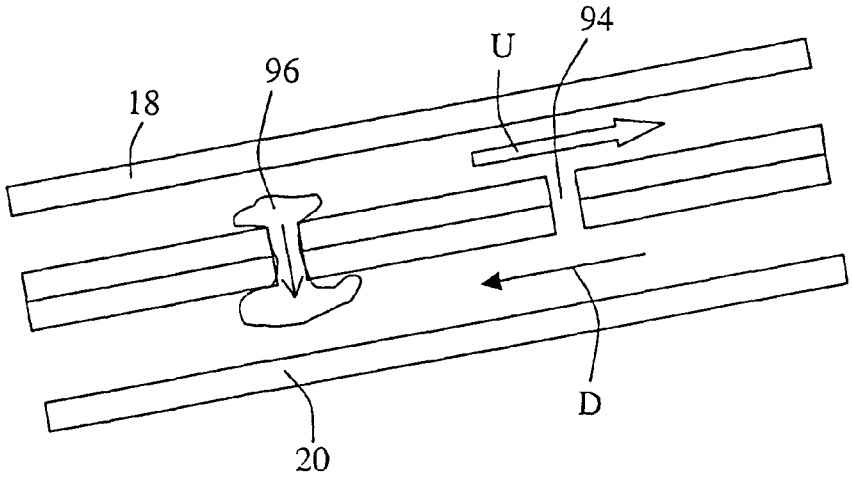

FIG. 3A shows a side view onto a further embodiment of a spray unit having a steam nozzle 62 and a draining opening 90. The steam nozzle 62 is connected to the steam hose 18 and the draining opening 90 is connected to the drain hose 20 shown in FIG. 1. Steam is coming in the upstream direction U from steam generator 14, and drain hose 20 connects in a downstream direction D to condensate reservoir 22. In this case, a capillary groove (not shown) connects the rim of the steam nozzle opening to the draining opening 90. The injected steam is indicated by arrow 92, while the bent arrow shows the draining of the condensed fluid into the drain hose 20. Between the two hoses 18, 20 capillary vias 94 are provided, such that steam condensed in steam hose 18 can be sucked into the via 94 and from there can enter the drain hose 20. FIG. 3B shows in more detail a cross-section through hoses 18 and 20 where a droplet 96 can be seen which passes through via 94 into the drain hose 20.

Figure 4A:
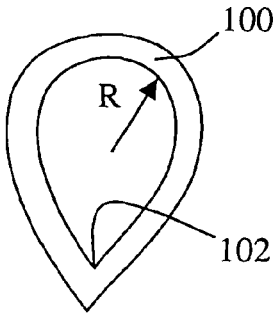

FIG. 4A shows another embodiment of a supply hose 100 used for example as the steam hose 18 shown in FIG. 1. In the cross-section of the supply hose 100 a draining edge 102 is provided which runs along the hose's length. The draining edge 102 reduces the surface tension energy of droplets, such that the droplets distribute or deliquesce along the edge, and the draining of the fluid is improved thereby.

Figure 4B:
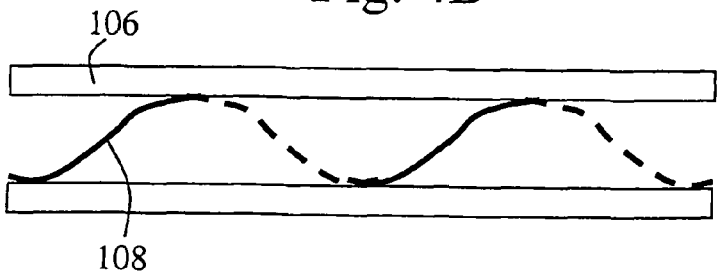

FIG. 4B shows another embodiment of a supply hose 106 having improved draining properties by providing a spiral element 108 running along the interior of the supply hose 106. A capillary effect is again provided between the inner surface of the hose and the spiral element 108, such that condensate drains off along the spiral element without forming larger diameter droplets.

| Reference Numerals List | |
|---|---|
| 2 | refreshment dryer |
| 4 | drum |
| 6 | nozzle unit |
| 8 | spray nozzle |
| 10 | drip collector |
| 12 | supply unit |
| 14 | steam generator |
| 16 | pump |
| 18 | steam hose |
| 20 | drain hose |
| 22 | sink/condensate reservoir |
| 24 | tub drainage |
| 26 | filter |
| 28 | pump |
| 30 | condensate line |
| 32 | outlet |
| 34 | condensate drawer |
| 36 | filter |
| 38 | additive tank |
| 40 | additive line |
| 42 | freshwater tap |
| 44 | valve/doser |
| 46 | decalcifier |

-continued

| Reference Numerals List | |
|---|---|
| 48 | water line |
| 50 | second additive reservoir |
| 52 | pump |
| 60 | nozzle unit |
| 62 | steam nozzle |
| 64 | additive nozzle |
| 66 | screw hole |
| 68 | door frame |
| 70 | loading opening |
| 72 | groove |
| 74 | fluid ledge |
| 80 | spray unit |
| 82 | capillary grooves |
| 84 | guiding vane |
| 88 | spray unit |
| 90 | drain opening |
| 92 | steam jet |
| 94 | via |
| 96 | droplet |
| 100 | supply hose |
| 102 | draining edge |
| 106 | supply hose |
| 108 | spiral element |

The invention claimed is:

1. A laundry appliance comprising:

a rotatable drum;

a loading opening for loading articles to be treated by an additive into said drum;

a loading door;

at least one additive supply source;

a nozzle arrangement adapted to supply at least one fluid-phase additive into said rotatable drum, said nozzle arrangement comprising at least one nozzle adapted to spray or inject steam into said rotatable drum;

at least one fluid channel connecting the at least one additive supply source to the nozzle arrangement; and at least one trapping device adapted to trap and remove liquid condensate leaving the at least one nozzle, or forming at or close to the nozzle outside of the nozzle and fluid channel, during said spray or injection of steam into said drum, said trapping device comprising a draining channel external of said nozzle and said fluid channel for draining the liquid condensate away from said nozzle and its spray/injection path while allowing steam to be sprayed or injected into said drum, said draining channel being selected from the group consisting of a groove, a via, a ledge, a hose and a line.

2. A laundry appliance according to claim 1, wherein the at least one trapping device comprises one or more capillary elements and/or comprises at least partially an anti-adhesive surface layer, a surface tension reducing surface layer, a porous surface structure, or a combination thereof.

3. A laundry appliance according to claim 1, wherein the draining channel is in fluid communication with a container for at least temporarily collecting the discharged fluid.

4. A laundry appliance according to claim 1, wherein the at least one trapping device or at least a portion thereof and/or the at least one nozzle is movably arranged.

5. A laundry appliance according to claim 4, wherein the at least one trapping device or at least a portion thereof and/or the at least one nozzle has a retracted position and/or a projecting position.

6. A laundry appliance according to claim 1, wherein the at least one trapping device is arranged downstream and below the at least one nozzle.

7. A laundry appliance according to claim 1, wherein said at least one fluid channel comprises at least one capillary element, an anti-adhesive surface layer, a surface tension reducing surface layer, or a combination thereof.

8. A laundry appliance according to claim 7, wherein the at least one fluid channel comprises a capillary element formed at least partially at the inner surface of the at least one fluid channel.

9. A laundry appliance according to claim 8, wherein the capillary element extends at least partially along the length of the at least one channel.

10. A laundry appliance according to claim 7, wherein a cross-section of the channel has at least one angle below 140°, and/or is tapered.

11. A laundry appliance according to claim 8, wherein the capillary element is formed by a channel insert inserted into the inside of the channel, in particular a wire or a screw-line or spirally formed wire.

12. A laundry appliance according to claim 7, wherein at least two channels are connected at least over a portion of their length and at least one capillary fluid communication is provided between the insides of the at least two channels.

13. A laundry appliance according to claim 7, wherein at least one channel is adapted to supply upstream a gas-phase additive to the at least one nozzle and at least one channel is adapted to drain downstream a liquid formed by condensed gas-phase additive.

14. A laundry appliance according to claim 13, wherein the downstream channel is connected to a liquid collector or container.

15. A laundry appliance according to claim 1, wherein the nozzle arrangement is arranged at or close to the loading opening.

16. A laundry appliance according to claim 1, wherein the at least one trapping device is arranged at least partially at a door frame and/or at least partially at the door of the loading opening.

17. A laundry appliance according to claim 16, wherein the trapping device is or comprises at least one groove and/or a fluid ledge.

18. A laundry appliance according to claim 1, wherein at least one draining channel is arranged at a door frame and/or a door of the loading opening and/or formed at least partially between the door frame and the door.

19. A laundry appliance according to claim 18, wherein the draining channel is in communication with a container for at least temporarily collecting the discharged liquid condensate.

20. A laundry appliance according to claim 19, wherein the container is removably arranged in the appliance.

21. A laundry appliance according to claim 18, wherein the draining channel is in communication with an effluent drain exterior of the apparatus.

22. A laundry appliance according to claim 1, wherein at least one additive supplying device is connected to a valve or dosing unit and/or a pump, the valve or dosing unit and/or pump being connected to the at least one additive source.

23. A laundry appliance according to claim 1, wherein a supply device and/or the fluid channel and/or a portion thereof is/are arranged at or on a loading door and/or a door frame of the apparatus.

* * * * *